US006626061B2

(12) United States Patent
Sakamoto et al.

(10) Patent No.: US 6,626,061 B2
(45) Date of Patent: Sep. 30, 2003

(54) ACCELERATOR PEDAL DEVICE

(75) Inventors: Kazunori Sakamoto, Aichi (JP); Masahiro Kimura, Aichi (JP); Sumio Ito, Aichi (JP)

(73) Assignees: Aisin Seiki Kabushiki Kaisha, Kariya (JP); Ohashi Iron Works Co., Ltd., Aichi (JP)

( * ) Notice: Subject to any disclaimer, the term of this patent is extended or adjusted under 35 U.S.C. 154(b) by 0 days.

(21) Appl. No.: 10/103,841

(22) Filed: Mar. 25, 2002

(65) Prior Publication Data

US 2002/0152831 A1 Oct. 24, 2002

(30) Foreign Application Priority Data

Mar. 23, 2001 (JP) ..... P2001-085656
Mar. 23, 2001 (JP) ..... P2001-085660

(51) Int. Cl.[7] ..... G05G 1/14
(52) U.S. Cl. ..... 74/512; 74/513; 74/560
(58) Field of Search ..... 74/512–514, 560; 123/399; 188/74, 166, 378, 379, 380; 192/41 R

(56) References Cited

U.S. PATENT DOCUMENTS 5,937,707 A * 8/1999 Rixon et al. ..... 74/560
6,070,490 A 6/2000 Aschoff et al.
6,276,229 B1 * 8/2001 Gohring et al. ..... 74/513
6,289,762 B1 * 9/2001 Silva ..... 74/513
6,360,631 B1 * 3/2002 Wortmann et al. ..... 74/513
6,446,526 B2 * 9/2002 Reimann et al. ..... 74/512

FOREIGN PATENT DOCUMENTS

DE 10020486 A1 * 10/2001 ..... 74/513
GB 2349447 A * 11/2000 ..... 74/513
JP 7-180573 A 7/1995
JP 2002-79844 * 3/2002 ..... 74/513

* cited by examiner

*Primary Examiner*—Vinh T. Luong
(74) *Attorney, Agent, or Firm*—Burns, Doane, Swecker & Mathis, LLP

(57) ABSTRACT

An accelerator pedal device includes a pedal arm, a liner, a hysteresis lever, and a spring. The pedal arm is pivotally supported on a housing and tilted by accelerator manipulation. The liner is formed on the pedal arm in the vicinity of a pivoting point of the pedal arm. The resilient hysteresis lever is engaged with the housing to cross the pedal arm. The hysteresis lever includes a sliding portion sliding on the liner. The spring is interposed between a pedal arm side opposite to a point of force to which an accelerator manipulation force is applied of the pivoting point regarding the pedal arm and a side of the hysteresis lever opposite to a portion engaged with the housing regarding the sliding portion. The spring elongates and contracts in response to tilting of the pedal arm to generate a reaction force and a hysteresis load.

15 Claims, 3 Drawing Sheets

ACCELERATOR PEDAL DEVICE

BACKGROUND OF THE INVENTION

1. Field of the Invention

The present invention relates to an accelerator pedal device.

2. Description of the Related Art

U.S. Pat. No. 6,070,490 discloses an accelerator pedal device that includes a pedal reaction force spring for generating a reaction force against an accelerator manipulation force applied to an accelerator pedal and a hysteresis spring for generating a hysteresis load. The pedal reaction force spring and the hysteresis spring are separately formed. The accelerator pedal device further includes a hysteresis generating member and the like arranged only at one side of an accelerator pedal arm thereof.

The accelerator pedal device disclosed in U.S. Pat. No. 6,070,490 has problems as explained hereinafter.

The first problem is that, since the pedal reaction force spring and the hysteresis spring are formed as separate members, even if a malfunction occurs with respect to the operation of the pedal reaction force spring, only the hysteresis load remains, which results in giving discomfort to a driver in the return of the accelerator pedal.

The second problem is that, since the hysteresis generating member and the like are arranged only at one side of the accelerator pedal arm, it is feared that the load applied to an shaft of the accelerator pedal arm increases.

SUMMARY OF THE INVENITON

It is an object of the present invention to provide an accelerator pedal device which can considerably prevent the generation of discomfort in the accelerator manipulation and, at the same time, can prevent an excessively large load from being applied to an accelerator pedal shaft.

According to the present invention, there is provided an accelerator pedal device including an accelerator pedal arm, a liner, a hysteresis lever and a resilient member. The accelerator pedal arm is pivotally supported on a housing and tilted in response to accelerator manipulation. The liner is formed on the accelerator pedal arm in the vicinity of a pivoting point of the accelerator pedal arm. The hysteresis lever is resilient and is engaged with the housing to cross the accelerator pedal arm. The hysteresis lever includes a sliding portion slidable on the liner. The resilient member is interposed between a side of the accelerator pedal arm opposite to an applied point of an accelerator manipulation force with respect to the pivoting point of the accelerator pedal arm and a side of the hysteresis lever opposite to a portion engaged with the housing with respect to the sliding portion. The resilient member elongates and contracts in response to tilting of the accelerator pedal arm to generate a reaction force against the accelerator manipulation force and a hysteresis load due to sliding between the liner and the sliding portion.

The manner of operation of the accelerator pedal device is explained with respect to a case in which the accelerator pedal arm is manipulated by an accelerator pedal mounted on the accelerator pedal arm. When an accelerator manipulator steps on the accelerator pedal so as to tilt the accelerator pedal arm in a predetermined direction, the resilient member which is interposed between a given portion of the accelerator pedal arm and a given position of a hysteresis lever is contracted or elongated so that a reaction force which faces an accelerator manipulating force (a so-called pedal reaction force) and a hysteresis load are generated. Accordingly, the accelerator manipulator can have a reasonable moderation feeling at the time of acceleration and can maintain the accelerator pedal at a fixed position with a manipulation force smaller than a manipulation force necessary at the time of stepping-in the accelerator pedal when the accelerator pedal is to be maintained at the fixed position.

According to the accelerator pedal device, the resilient member is interposed between the accelerator pedal arm and the hysteresis lever which are arranged to cross each other. The interposed resilient member prevents an excessively large load from being applied to a pivoting portion of the accelerator pedal arm.

According to the accelerator pedal device, the resilient member which generates a reaction force (pedal reaction force) against an accelerator manipulating force and the resilient member which generates a hysteresis load are formed of the same member. Accordingly, even if a malfunction occurs with respect to the operation of the resilient member, both of the pedal reaction force and the hysteresis load which act in the directions opposite to each other can be cancelled or decreased so that large discomfort in the return of the accelerator pedal hardly occurs as much as possible.

DETAILED DESCRIPTION OF THE PRESENT INVENTION

The present invention will be described with reference to the accompanying drawings.

Figure 1:
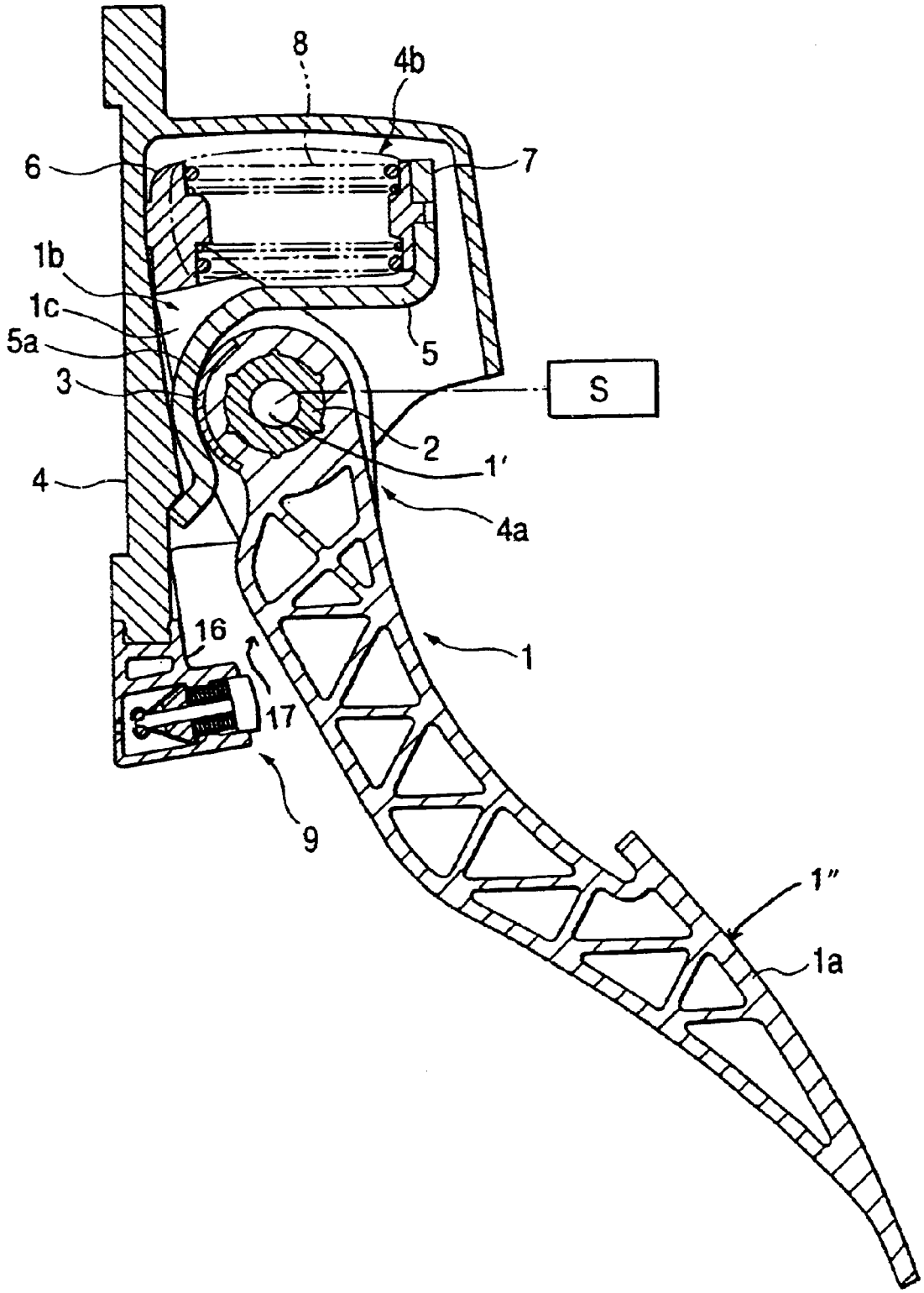
FIG. 1 is an explanatory view of an accelerator pedal device according to one embodiment of the present invention.

FIG. 1 is an explanatory view of an accelerator pedal device according to one embodiment of the present invention. Referring now to FIG. 1, an accelerator pedal arm shaft 2 is pivotally and rotatably mounted on a housing 4. A pivoting portion (boss portion) of an accelerator pedal arm 1 is brought into spline engagement with an outer peripheral portion of the accelerator pedal arm shaft 2. Due to such a constitution, the accelerator pedal arm 1 is pivotally mounted on the housing 4 and tilted by the accelerator manipulation. Further, an accelerator pedal 1*a* is formed on one end of the accelerator pedal arm shaft 2. A liner 3 is provided or formed on a portion of the accelerator pedal arm 1 which is disposed in the vicinity of a pivoting point 1' of the accelerator pedal arm 1 (in the vicinity of the accelerator pedal arm shaft 2). The accelerator pedal arm 1 includes an arm portion 1*c* extending upwardly from the pivoting point thereof. A hole 1*b* is formed in a widthwise center portion of the arm portion 1*c*.

Further, to perform a kickdown control, an accelerator opening sensor S which detects a rotation angle of the pedal arm shaft 2 is mounted on the housing 4. Various types of known sensors can be used as the accelerator opening sensor S. A vehicle which mounts the accelerator pedal device can perform the transmission control, the timing control of fuel injection and the like suitable for the kickdown based on the rotation angle of the pedal arm shaft 2 or the like using detection signals outputted from the accelerator opening sensor S (the detection signal of the rotation angle of the pedal arm shaft 2 or the tilting angle of the accelerator pedal arm 1).

Further, a hysteresis lever 5 is arranged to be inserted into the hole 1*b* of the accelerator pedal arm 1 and to cross the accelerator pedal arm 1. The hysteresis lever 5 has one end thereof engaged with the housing 4. The hysteresis lever 5 includes a sliding portion 5*a* which is resilient and slides on the liner 3.

A spring 8 is interposed between a portion of the accelerator pedal arm 1 disposed opposite to a point of force 1" to which the accelerator manipulation force is applied with respect to the pivoting point 1' of the accelerator pedal arm 1 and a portion of the hysteresis lever 5 disposed opposite to the portion which is engaged with the housing 4 with respect to the sliding portion 5*a*. The spring 8 is elongated or contracted in response to the tilting of accelerator pedal arm 1 and generates a reaction force against the accelerator manipulating force in an opposed manner and a hysteresis load due to the sliding between the liner 3 and the sliding portion 5*a*. Further, the liner 3 and the sliding portion 5*a* are formed in an arcuate shape and an arc of the sliding portion 5*a* is formed larger than an arc of the liner 3 on a sliding surface between the liner 3 and the sliding portion 5*a*.

On a portion of the housing 4 disposed below the pivoting point of the accelerator pedal arm 1, that is, at the same side of the accelerator pedal 1*a*, a kickdown load generating mechanism 9 and a stopper 16 are mounted and close to each other. The stopper 16 comes into contact with a counter stopper portion 17 formed on the accelerator pedal arm 1 so as to stop the tilting of the accelerator pedal arm 1 in a predetermined direction. Due to such a constitution, when the stopper 16 comes into contact with the counter stopper portion 17, the accelerator opening sensor S does not receive the influence of delicate deformation of the accelerator pedal arm 1 due to the manipulating load of the accelerator pedal 1*a* so that the accurate output of the accelerator opening sensor S can be always ensured or compensated. Further, even in an emergency case in which an excessively large load is applied to the accelerator pedal 1*a* so that the accelerator pedal arm 1 ruptures, the accelerator pedal arm 1 ruptures at the counter stopper portion 17 so that the influence of rupture to the accelerator opening sensor S disposed above the counter stopper portion 17 can be avoided thus ensuring the safety of the accelerator pedal device.

Here, the housing 4 includes an open hole 4*a* into which a portion of the accelerator pedal arm 1 disposed in the vicinity of the pivoting point is inserted and a window 4*b* which is formed such that the window 4*b* is opened in a surface which substantially crosses the open hole 4*a* at a right angle, and is communicated with the open hole 4*a* and through which the spring 8 is inserted.

Figure 2:
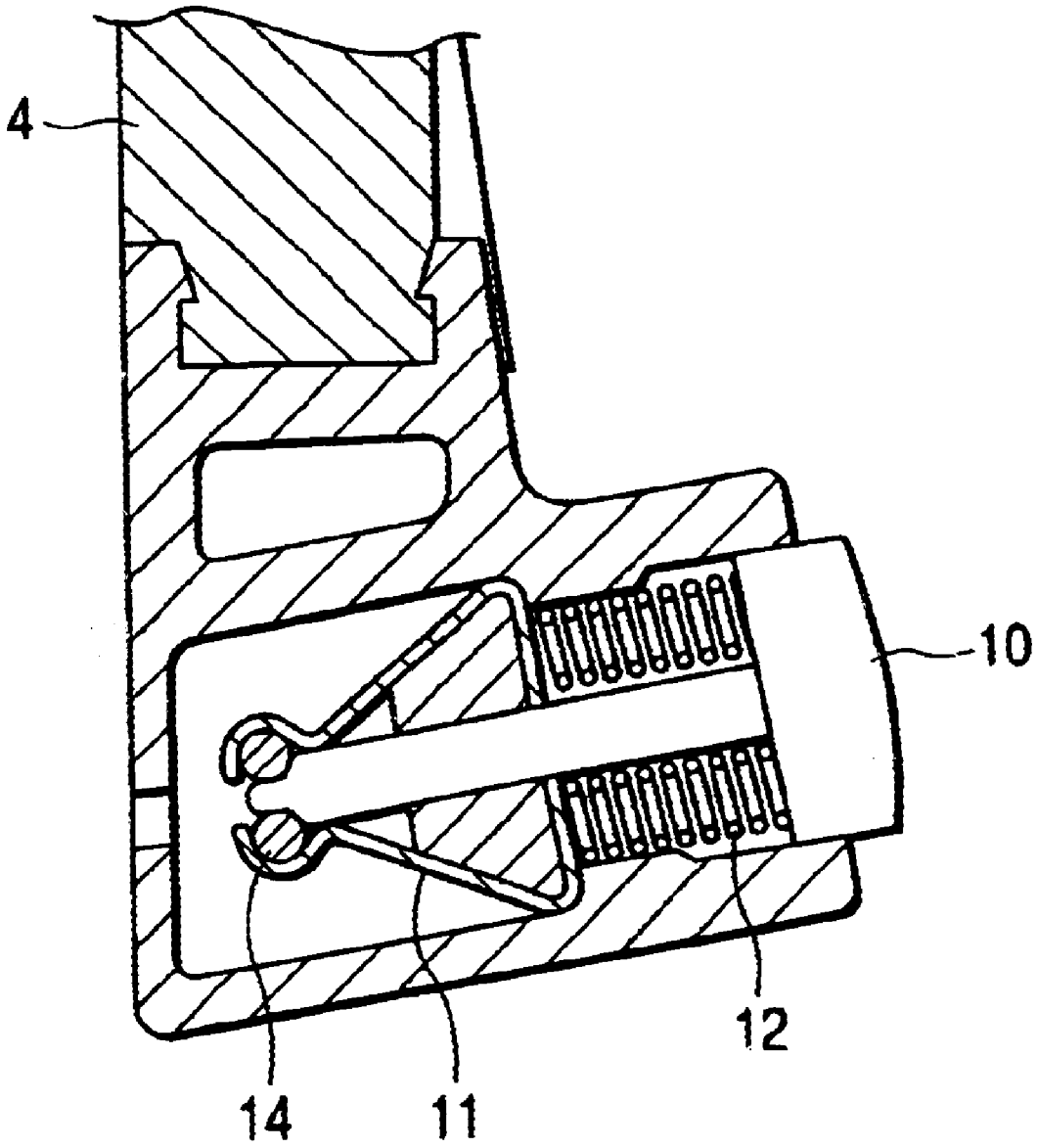
FIG. 2 is an enlarged view of a kickdown load generating mechanism provided to the accelerator pedal device shown in FIG. 1.

Subsequently, a kickdown load generating mechanism 9 shown in FIG. 1 is explained. FIG. 2 is an enlarged view of the kickdown load generating mechanism 9 provided to the accelerator pedal device shown in FIG. 1.

As shown in FIGS. 1 and 2, the kickdown load generating mechanism 9 includes a plunger 10 which is brought into contact with the accelerator pedal arm 1 and biased when the accelerator pedal arm 1 is tilted by a predetermined angle, a leaf spring 11 which is engaged with the housing 4 and allows the plunger 10 to pass therethrough, a kickdown load spring 12 which is interposed between the plunger 10 and the leaf spring 11, and rollers 14 which are sandwiched between a distal end of the plunger 10 and a notched portion formed on a distal end of the leaf spring 11. This kickdown load mechanism 9 can give a given moderation feeling to an accelerator manipulator when a kickdown load is applied to the accelerator pedal shaft 1.

Figure 3:
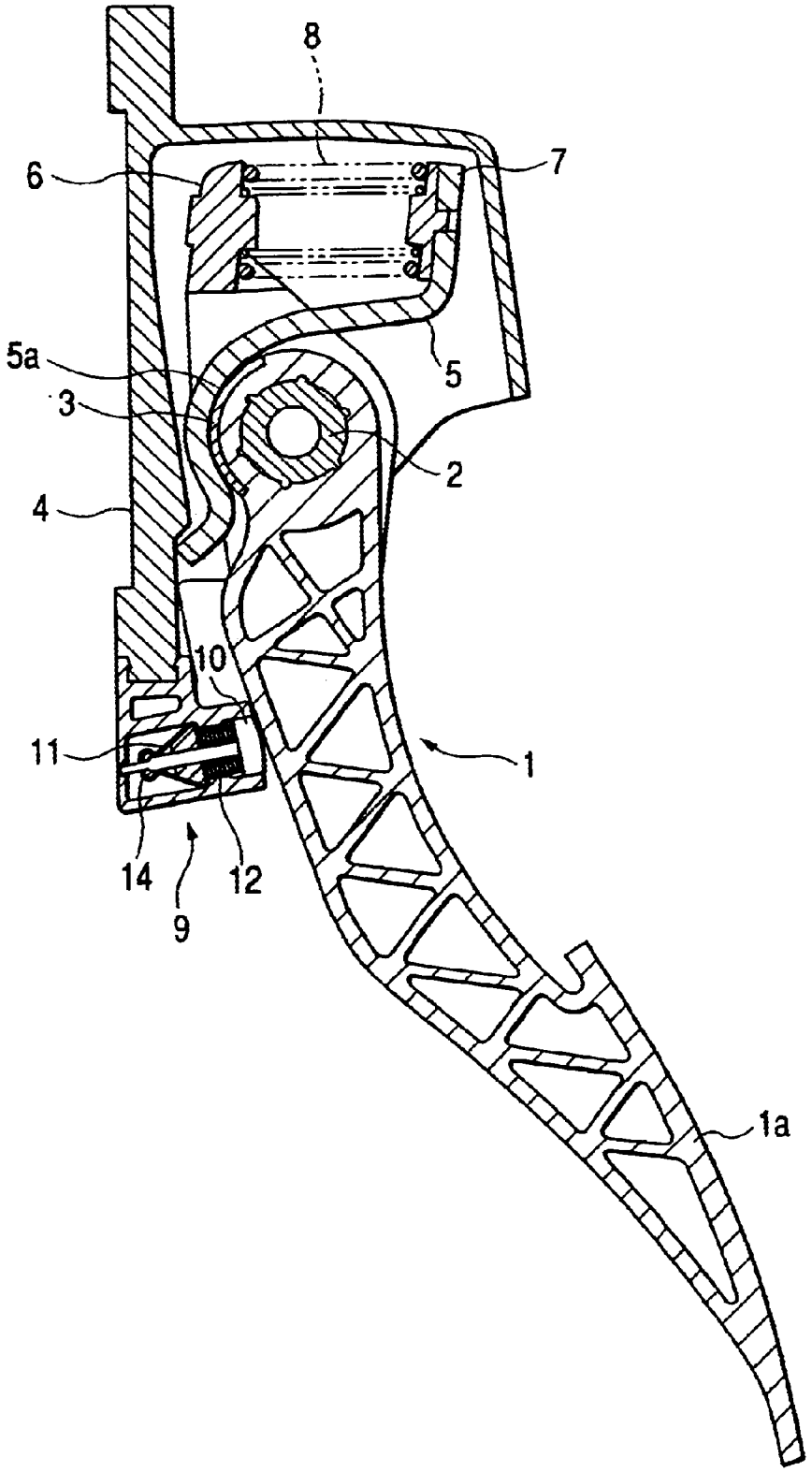
FIG. 3 is an operational view of the accelerator pedal device shown in FIG. 1.

Then, the manner of operation of the above-mentioned accelerator pedal device is explained. FIG. 3 is an operational view of the accelerator pedal device shown in FIG. 1.

As shown in FIGS. 1 and 3, when the accelerator manipulator steps in the accelerator pedal la so as to tilt the accelerator pedal arm 1 in a predetermined direction, the spring 8 is compressed so that the pedal reaction force and the hysteresis load are generated. Accordingly, the accelerator manipulator can have the reasonable moderation feeling at the time of acceleration. Further, when the accelerator pedal 1*a* is maintained at a fixed position, the accelerator pedal 1*a* can be maintained at the fixed position with a manipulating force smaller than a manipulating force necessary for stepping in the accelerator pedal 1*a*.

Further, according to this accelerator pedal device, the hysteresis lever 5 is inserted into the hole 1*b* formed in the widthwise center portion of the accelerator pedal arm 1, while the hysteresis lever 5 and the accelerator pedal arm 1 are arranged to cross each other. Further, the spring 8 is also arranged at the widthwise center portion of the accelerator pedal arm 1. Accordingly, the accelerator pedal arm shaft 2 which is pivotally supported on the housing 4 can uniformly support the load at both ends thereof so that it is possible to prevent an excessively large load from being applied to the accelerator pedal arm shaft 2.

In addition, according to this accelerator pedal device, since the resilient member 8 which generates the pedal reaction force and the resilient member which generates the hysteresis load are formed of the same member (spring 8), even if a malfunction occurs with respect to the operation of the spring 8, both of the pedal reaction force and the hysteresis load which act in the directions opposite to each other can be cancelled or decreased so that the generation of the large discomfort in the return of the accelerator pedal 1*a* can be prevented as much as possible.

Subsequently, the manner of operation of the above-mentioned accelerator pedal device at the time of kickdown is explained.

As shown in FIGS. 1 and 3, when an accelerator manipulator steps in the accelerator pedal la so as to tilt the accelerator pedal arm 1 by a predetermined angle in a predetermined direction, the accelerator pedal arm 1 comes into contact with the plunger 10 and pushes the plunger 10. Accordingly, the plunger 10 is made to project from a notched portion of the leaf spring 11 while compressing the kickdown load spring 12. Here, a distal end of the plunger 10 is engaged with a notched portion formed on a distal end of the leaf spring 11 with a strong force by way of the rollers 14. Accordingly, a large reaction force, that is, the kickdown load is applied to the accelerator pedal arm 1. When the plunger 10 is further pushed, the engagement of the distal end of the plunger 10 and the notched portion of the leaf spring 11 by way of the rollers 14 is released soon so that the distal end of the plunger 10 projects from the notched portion of the leaf spring 11. Accordingly, the reaction force against the plunger 10 is reduced so that the plunger 10 can be pushed with a relatively small step-in force thereafter.

When the accelerator manipulator further steps in the accelerator pedal 1*a* so as to tilt the accelerator pedal arm 1 in a predetermined direction by a predetermined angle, this time, the counter stopper portion 17 formed on the accelerator pedal arm 1 is brought into contact with the stopper 16 formed on the housing 4. Accordingly, the further tilting of the accelerator pedal arm 1 in the above-mentioned direction can be stopped.

According to the invention, the liner and the sliding portion are formed in an arcuate shape. An arc of the sliding portion is formed larger than an arc of the liner on a sliding surface formed between the liner and the sliding portion. Even when the hysteresis lever is deformed largely by the resilient member, it is possible to prevent a phenomenon that the hysteresis lever entangles itself with the accelerator pedal arm or the accelerator pedal arm shaft or sandwiches them. As a result, the hysteresis load is generated in a stable manner. In addition, according to the invention, the position where the sliding portion of the hysteresis lever is brought into slide contact with the liner becomes stable. This further contributes to the stabilization of the hysteresis load.

According to the invention, the housing includes an open hole (including an opening which has a normal line in the front-and-back direction in FIG. 1) in which a portion of the accelerator pedal arm in the vicinity of the pivoting point is inserted and a window which is formed such that the window is opened in a surface which substantially crosses the open hole at a right angle and is communicated with the open hole and through which the resilient member is inserted. According to the invention, the housing (pedal housing) can be integrally formed by molding (thus exhibiting excellent productivity) and the resilient member can be inserted into the above-mentioned housing (pedal housing) in the assembling step (thus also exhibiting the excellent assembling ability). Further, according to the invention, the invasion of a foreign substance into the housing can be effectively prevented. Here, the above-mentioned window can be closed by assembling an accelerator pedal sensor housing.

According to the invention, the accelerator pedal arm and the hysteresis lever are not offset from each other and are substantially arranged on the same line. Due to such a constitution, it is possible to prevent stress such as seizing or high friction from being applied to the pivoting portion of the accelerator pedal arm or the accelerator pedal arm shaft.

According to the invention, the hysteresis lever can be formed at a low cost using press material such as steel. On the other hand, the liner may be preferably made of resin. Thus, the sliding portion is formed of metal material and a portion which is brought into contact with the sliding portion is formed of resin so that this mode for carrying out the invention is advantageous in view of the durability of the device. Particularly, the whole accelerator pedal arm is preferably made of resin. In this case, a portion of the accelerator pedal arm which is brought into slight contact with the hysteresis lever constitutes the liner.

According to the invention, the accelerator pedal arm is pivotally mounted on the housing by way of the accelerator pedal shaft. The accelerator pedal arm and the accelerator pedal shaft are preferably brought into spline engagement with each other such that they are integrally rotated. Thus, the accelerate pedal shaft can be manufactured by press molding or can be manufactured using inexpensive material such as resin or metal.

According to the accelerator pedal device of the present invention, it is possible to perform the tuning of only the hysteresis of the pedal step-in characteristics by changing the pivoting point or the fulcrum of the hysteresis lever.

According to the present invention, it is possible to provide the accelerator pedal device which can highly effectively prevent the generation of the discomfort in the accelerator manipulation and can prevent the excessively large load from being applied to the accelerator pedal shaft.

What is claimed is:

1. An accelerator pedal device comprising:

an accelerator pedal arm pivotally supported on a housing and tilted in response to accelerator manipulation;

a liner formed on the accelerator pedal arm in the vicinity of a pivoting point of the accelerator pedal arm;

a hysteresis lever having a resiliency, the hysteresis lever engaged with the housing to cross the accelerator pedal arm, the hysteresis lever including a sliding portion slidable on the liner; and a resilient member interposed between a side of the accelerator pedal arm opposite to an applied point of an accelerator manipulation force with respect to the pivoting point of the accelerator pedal arm and a side of the hysteresis lever opposite to a portion engaged with the housing with respect to the sliding portion, the resilient member elongating and contracting in response to tilting of the accelerator pedal arm to generate a reaction force against the accelerator manipulation force and a hysteresis load due to sliding between the liner and the sliding portion.

2. The accelerator pedal device according to claim 1, wherein the liner and the sliding portion are formed in an arcuate shape; and an arc of the sliding portion is formed larger than an arc of the liner on a sliding surface formed between the liner and the sliding portion.

3. The accelerator pedal device according to claim 1, wherein the housing includes:

an open hole in which a portion of the accelerator pedal arm in the vicinity of the pivoting point is inserted; and a window opened in a surface substantially crossing the open hole at a right angle, the window communicated with the open hole, wherein the resilient member is inserted through the window.

4. The accelerator pedal device according to claim 1, wherein the hysteresis lever is disposed to pass through a hole formed in a widthwise center portion of the accelerator pedal arm and to cross the accelerator pedal arm.

5. The accelerator pedal device according to claim 1, further comprising:

an accelerator pedal arm shaft rotating in response to the accelerator manipulation to tilt the accelerator pedal arm;

an accelerator opening sensor for detecting a rotation angle of the accelerator pedal arm shaft for a kickdown control; and a kickdown load generating mechanism being pressed by the accelerator pedal arm when the accelerator pedal arm is tilted by a predetermined angle with respect to the housing, thereby to apply the reaction force to the accelerator pedal arm.

6. The accelerator pedal device according to claim 5, wherein a stopper for coming into contact with the accelerator pedal arm to stop the tilting of the accelerator pedal arm is mounted on the housing in the vicinity of the kickdown load generating mechanism.

7. The accelerator pedal device according to claim 6, wherein the kickdown generating mechanism and the stopper are arranged at an accelerator pedal side with respect to the pedal shaft.

8. The accelerator pedal device according to claim 6, wherein the kickdown load generating mechanism comprises:

a plunger brought into contact with the accelerator pedal arm when the accelerator pedal arm is tilted by a predetermined angle;

a leaf spring being engaged with the housing and allowing the plunger to pass therethrough;

a kickdown load spring interposed between the plunger and the leaf spring; and a plurality of rollers sandwiched between a distal end of the plunger and a distal end of the leaf spring.

9. An accelerator pedal device comprising:

an accelerator pedal arm pivotally supported on a housing and adapted to be tilted in response to accelerator manipulation;

a liner provided on the accelerator pedal arm in a vicinity of a pivoting point of the accelerator pedal arm;

a hysteresis lever engaged with the housing to cross the accelerator pedal arm, the accelerator pedal arm being tiltable relative to the hysteresis lever, the hysteresis lever including a deformable resilient sliding portion which slidably engages the liner during tilting of the accelerator pedal arm; and a resilient member interposed between a side of the accelerator pedal arm opposite to an applied point of an accelerator manipulation force with respect to the pivoting point of the accelerator pedal arm and a side of the hysteresis lever opposite to a portion engaged with the housing with respect to the sliding portion, the resilient member elongating and contracting in response to tilting of the accelerator pedal arm to generate a reaction force against the accelerator manipulation force and a hysteresis load due to sliding between the liner and the sliding portion.

10. The accelerator pedal device according to claim 9, wherein the liner and the resilient sliding portion are both arc-shaped, the arc forming the resilient sliding portion being formed larger than the arc forming the liner.

11. The accelerator pedal device according to claim 9, wherein the housing includes an open hole in which a portion of the accelerator pedal arm is inserted, and a window opening to a surface substantially crossing the open hole at a right angle, the window communicating with the open hole, the resilient member being inserted through the window.

12. The accelerator pedal device according to claim 9, wherein the hysteresis lever passes through a hole formed in a widthwise center portion of the accelerator pedal arm.

13. The accelerator pedal device according to claim 9, further comprising:

an accelerator pedal arm shaft rotating in response to the accelerator manipulation to tilt the accelerator pedal arm;

an accelerator opening sensor detecting a rotation angle of the accelerator pedal arm shaft for a kickdown control; and a kickdown load generating mechanism pressed by the accelerator pedal arm when the accelerator pedal arm is tilted by a predetermined angle with respect to the housing, to thereby apply a reaction force to the accelerator pedal arm.

14. The accelerator pedal device according to claim 13, wherein the kickdown generating mechanism is arranged at an accelerator pedal side with respect to the pedal shaft.

15. The accelerator pedal device according to claim 13, wherein the kickdown load generating mechanism comprises:

a plunger which contacts the accelerator pedal arm when the accelerator pedal arm is tilted by a predetermined angle;

a leaf spring engaged with the housing;

a kickdown load spring interposed between the plunger and the leaf spring; and a plurality of rollers sandwiched between a distal end of the plunger and a distal end of the leaf spring.

* * * * *